United States Patent [19]

Kakovitch

[11] 4,042,244

[45] Aug. 16, 1977

[54] MOBIUS TOY

[76] Inventor: Thomas S. Kakovitch, 561 S. Hampton, Silver Spring, Md. 20903

[21] Appl. No.: 680,808

[22] Filed: Apr. 27, 1976

[51] Int. Cl.[2] ..... A63B 71/04; A63F 7/00

[52] U.S. Cl. ..... 273/109

[58] Field of Search ..... 273/109, 113, 112; 46/43

[56] References Cited

U.S. PATENT DOCUMENTS

| | | | |
|---|---|---|---|
| 440,160 | 11/1890 | Hoyt | 273/109 |
| 1,564,132 | 12/1925 | France | 46/43 |
| 1,972,587 | 9/1934 | Fairchild | 273/109 |
| 2,614,361 | 7/1952 | Marong | 273/109 |
| 3,060,627 | 10/1962 | Seretny | 273/109 |
| 3,502,335 | 3/1970 | Sholin | 273/109 |
| 3,626,633 | 12/1971 | Meyer | 273/113 |
| 3,758,981 | 9/1973 | Hlasnicek et al. | 273/109 |

*Primary Examiner*—Richard C. Pinkham
*Assistant Examiner*—Lawrence E. Anderson

[57] ABSTRACT

A hand-held toy is disclosed by which the manual dexterity and concentration of the user is challenged. The toy in its preferred embodiment constitutes a continuous Mobius ring formed from an elongated band having grooves disposed in both sides thereof, the grooves defining a raceway for a rolling ball-like playing piece and with the band being twisted about its longitudinal axis through an odd number of turns and having its ends permanently joined together. An aperture is disposed in the band which communicates with the grooves to either side of the band. The aperture being selectedly closed by one-way door means. A handle is provided to be gripped by the user, the handle being disposed across the Mobius ring and defining an approximation of the diameter.

The toy is utilized by placing one or more rolling ball-like playing pieces or marbles in the grooves and then, through manipulation of the Mobius ring, the ball can be rolled in the grooves through a distance of up to 720° or, the ball can be rolled through the open door and aperture through a shorter angular distance to facilitate playing action. A removable arched cover can be provided over one of the grooves adjacent the door to further facilitate playing.

6 Claims, 8 Drawing Figures

MOBIUS TOY

BACKGROUND OF THE INVENTION

This invention generally relates to toys and is particularly directed to manually operated toys designed to challenge the dexterity and concentration of the user.

Many hand-held or hand-operated toys designed to challenge the dexterity and/or concentration of the user are in existence, but most part such as to appeal to very limited markets due to the fact that such existing toys can generally be operated only in one manner or mode having associated with it but a single level of required skill. Thus, a toy designed to challenge the manual dexterity and/or concentration of the child, for example, would probably not appeal to an adult user in that the operation of such toy would conceivably be trivial or too easy for such an adult. Similarly, adult manual dexterity toys generally could not be successfully operated by children.

Additionally, and as concerns the great bulk of manual dexterity toys generally commercially available today, the basic principle of operation or construction thereof is not such as to provide the user with a continuing fascination or appeal. Therefore, shortly after such toys are purchased and following a relatively short playing time with such toys, they are typically discarded or forgotten.

SUMMARY OF THE INVENTION

It is a primary objective of the instant invention to provide a hand-held toy of extremely fascinating construction and operation, and which is capable of being utilized in a variety of playing modes so as to effect a continuous challenge to various market segments and age groups.

A further objective of the instant invention is to provide a hand-held toy which can be constructed most economically to thus be affordable by virtually everyone.

These as well as other objectives of the instant invention which will become clear as the description proceeds, are implimented herein by the provision of such a hand-held toy which utilizes the inherent fascinating qualities of the so-called Mobius strip or ring as its primary constructional feature. The Mobius strip or ring can be deemed to be constructed of an elongated band which has grooves disposed in both sides, these grooves defining a raceway to receive a rolling ball-like playing piece or pieces such as a marble. The elongated band is twisted about its longitudinal axis through an odd number of turns, i.e. 1, 3, 5 or the like, with the ends of the band being permanently joined together to define the continuous Mobius ring.

A handle is disposed on the Mobius ring to provide an area which can be gripped by the user and from which the toy can be manipulated by hand. For maximum mobility of the Mobius ring, the handle is contemplated in the preferred embodiment for being disposed across the Mobius ring to define an approximation of the diameter of same, which handle can be gripped by the fingertips of the user.

At least one ball is disposed in the grooves of the Mobius ring and, through extremely careful manipulation of the Mobius ring, the balls can be rolled in the grooves about the Mobius ring up to the entire angular distance of 720°. Such a feat is, of course, extremely difficult to perform and requires the utmost level of concentration and dexterity of the user.

To simplify the operation of the toy, a preferred inventive embodiment is contemplated to incorporate an aperture which is disposed in the elongated band and which serves to communicate with the grooves to either side of the band. The aperture is selectively opened or closed by door means positioned therein and, when the door means are open, a rolling ball in the groove of the Mobius ring will be received in the aperture and can effectively go through the surface of the Mobius ring to the other "side" to limit the angular movement of the ball to 360°. While difficult, this mode of operation does not rise to the level of difficulty of that mode first-discussed.

To even further simplify the operation of the toy, a removable arcuate and arched cover can be disposed over the groove along a selected distance on one side of the band at the region of door. With the cover in place, the probability of the ball inadvertently dropping out of a groove at the critical transition region of the door is reduced and, in this mode, the level of dexterity and concentration required is at a minimum.

In yet another preferred embodiment of the instant invention, the elongated band can be constructed to exhibit an S-shaped cross-section to form the continuous Mobius ring. The aperture and door mechanism, as well as the cover if desired, can be eliminated from the construction. What results in this instance is a Mobius toy which, while challenging the dexterity of even the most expert user, can be constructed at an absolute minimum of cost.

BRIEF DESCRIPTION OF THE DRAWINGS

The invention itself will be better understood to further advantageous features thereof appreciated from the following detailed description of the preferred inventive embodiments, which description makes reference to the appended sheets of drawings wherein.

DETAILED DESCRIPTION OF THE DRAWINGS

Figure 1:
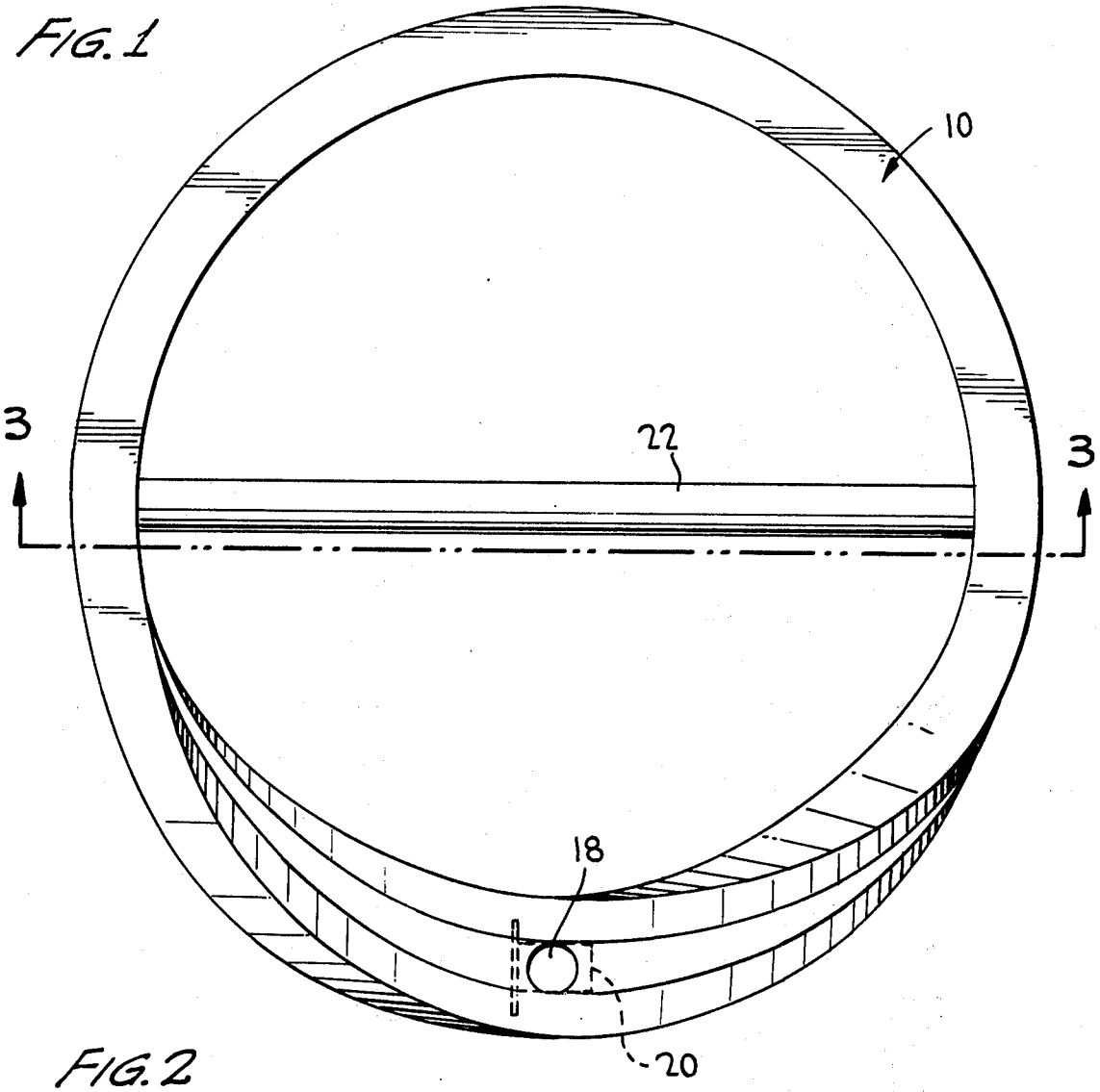
FIG. 1 is a perspective illustration of the hand-held Mobius toy of the instant invention.
Figure 2:
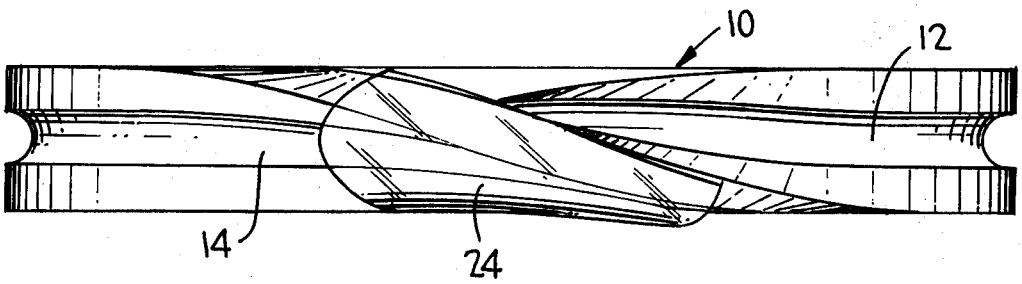
FIG. 2 is a side elevational view of the Mobius toy of FIG. 1.
Figure 3:
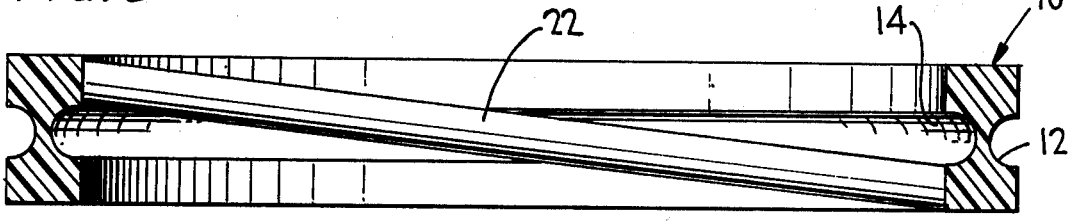
FIG. 3 is a further side elevational view, partially in section, of the Mobius toy of FIG. 1 with the section taken along the lines 3—3 of FIG. 1.

Reference now is directed to the appended sheet of drawings and particularly to FIGS. 1 through 3 thereof in which Figures and as is the case with all the Figures, like parts have been indicated by the same reference numeral.

The hand-held toy for challenging the manual dexterity and concentration of the user comprises an elongated band generally designated by reference numeral 10 of any suitable material such as plastic which will provide sufficient lightness yet exhibit sufficient strength for this environment of utility. Disposed in both sides of the elongated band 10 are grooves 12 and 14, which grooves serve to define a raceway for a rolling ball-like playing piece such as a marble 16. The specific shape, form, and/or depth of grooves 12 and 14 is not critical. The primary requirement being that such grooves can receive and at least partially confine the ball-like playing piece in the fashion of a bearing raceway.

The elongated band 10 is twisted about its longitudinal axis through at least one turn, though such band could be twisted through any odd number of turns, with the ends of the band 10 being permanently joined together to define a continuous Mobius ring as is shown.

Figure 4:
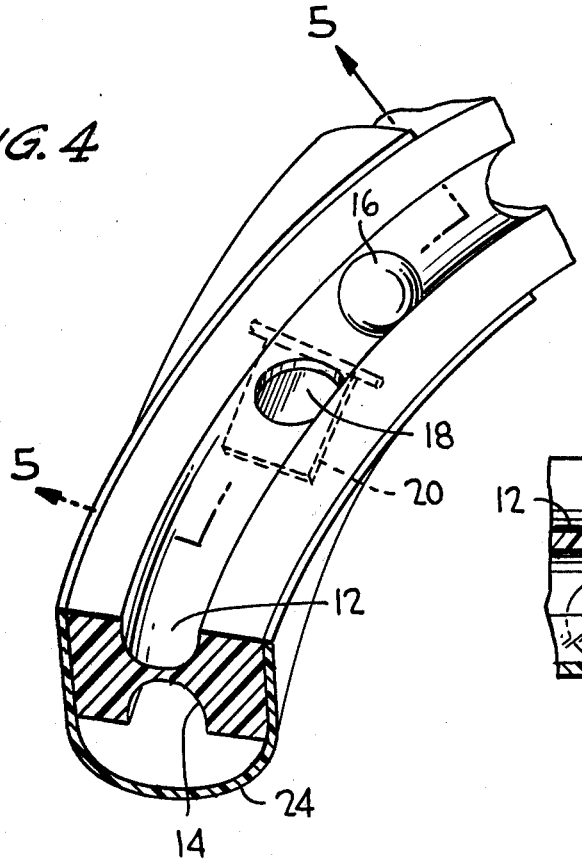
FIG. 4 is a cut-way illustration depicting one area of the Mobius ring of FIG. 1, such area being that in which the aperture and door is provided.
Figure 5:
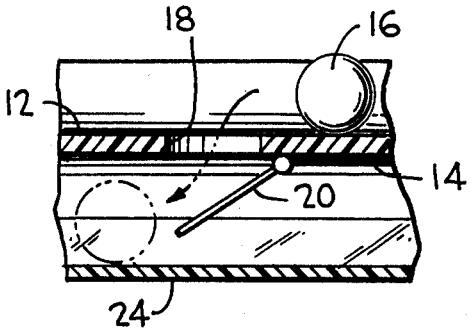
FIG. 5 is an elevational view, in section, taken along lines 5—5 of the embodiment depicted in FIG. 4.

In one preferred inventive embodiment, an aperture 18 such as indicated in FIGS. 4 and 5 is disposed in the band communicating with the grooves 12 and 14 to either side of the band, the aperture 18 having a diameter sufficiently large to receive the ball-like playing piece 16 therein, much as is schematically illustrated in FIG. 5 of the application drawings. Door means, such as hingedly mounted door or flap 20 is positioned in the aperture 18 to selectively open and close same. When the door means 20 is open as illustrated in FIG. 5, the rolling ball in a groove of the Mobius ring can drop through the aperture 18 into the groove on the opposite side of the elongated band. Depending upon direction of movement of the ball 16 and the physical orientation of the Mobius ring, such ball will also fall through the aperture 18 in a direction opposite to that shown in FIG. 5, i. e. from groove 14 to groove 12 with the door 20 in such instance defining a deflecting stop for the ball-like playing piece. As is also indicated in the preferred inventive construction, door means 20 is contemplated to open in but one direction, although modifications in such construction resulting in modifications in operation are additionally contemplated.

A handle mechanism or means 22 as is shown in FIGS. 1 and 3 is further provided, handle means 22 being disposed on the Mobius ring and coupled to the elongated band 10 for providing an area to be gripped by the user and from which the toy can be manipulated by hand. The preferred construction, handle 22 is contemplated to be disposed across the Mobius ring to define an approximation of diameter of the ring and, for purposes of improving the balance of the toy, the handle is illustrated as running from one surface of the elongated band to the other, i.e. at an inclination most clearly depicted in FIG. 3.

Figure 8:
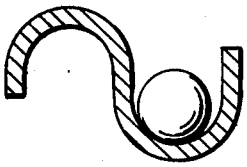
FIG. 8 is a sectional illustration of an alternative embodiment of the Mobius ring which utilizes an elongated band having an S-shaped cross-section.

The specific cross-sectional shape of the elongated band 10 generally is not of critical importance to the instant invention though, in one instance, and through the selection of an S-shaped cross-section as depicted in FIG. 8, certain economies in manufacturing of the apparatus can be effected though, in this instance as will be explained, it may be desirable to delete the provision of the aperture and door and plastic cover as has been described with respect to the embodiment of FIGS. 1 through 5.

Continuing, the constructional features of the Modius toy of the instant invention is completed through the provision of an arcuate, arched cover 24 which best be seen in FIGS. 2, 4 and 5 and which is illustrated as being disposed over the groove along a selected distance on one side of the elongated band 10 at the region of the door 20, such region being a "critical" transition region with respect to the rolling of the ball-like playing piece in at least one operational mode of the device as will be described hereinbelow. Specifically, and with respect to the desired direction of travel of the ball-like playing piece, the arcuate arched cover 24 is contemplated to have a length and be positioned so as to commence several inches prior to the aperture 18 and continue for a relatively longer distance thereafter. The arcuate arched cover 24 is further contemplated to not only be selectively removable from the elongated band-10 at the desire of the user, but further is contemplated to be constructed of a transparent plastic material so that the movement of the ball-like playing piece can be visually monitored at all times.

In operation, the device of the instant invention is designed to challenge the dexterity and concentation of the neophyte, the more daring, and the dexterious experts, all in dependence upon the specific mode of operations selected by the user.

Figure 6:
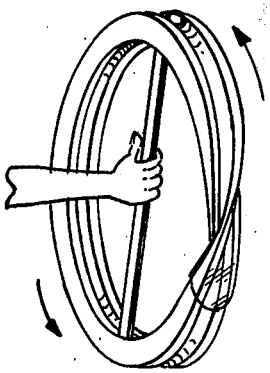
FIGS. 6 and 7 are perspective illustrations serving to demonstrate the manner in which the toy is operated by a user.
Figure 7:
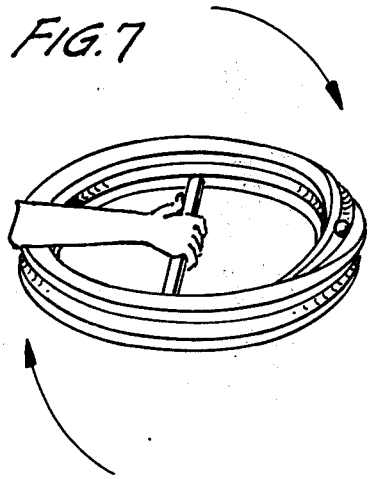

For neophyte use, door means 20 would be opened and the arcuate arched cover 24 would be disposed in place. The user would grasp the handle with all four fingers and thumb much as is indicated in FIG. 6 and 7 and would place a ball-like playing piece or marble 16 at the bottom of an inside groove. By twisting the wrist, the user could make the marble roll toward the non-hinged side of the open door 20 whereupon the rolling ball or marble would automatically roll or drop from the inside groove to the outside groove (just the reverse of the operation illustrated in FIG. 5 of the application drawings, for example). In a continuous motion, the user would let the marble thereafter drop through the open door 20 down to the inside groove and back to its original starting point, the rolling ball-like playing piece in this instance having then covered one half the total length of the elongated band or having rolled through an angular length of 360°.

The next level of difficulty as concerns the operation of the instant inventive device, a level of difficulty designed to challenge the more daring user, is achieved by closing door 20 but maintaining the arcuate arched cover 24 in place. Operation in this instance would be substantially the same as that described above for the neophyte. Yet, in this situation, and in that the rolling ball no longer could drop through the aperture 18, it would be necessary to roll the ball over the closed door 20 and cover the full length of the elongated band, i.e. an angular distance of 720°, before returning to the original starting point.

For dexterious experts, the operation of the device can be made even more difficult by maintaining door 20 closed but by removing the arcuate arched cover 24 and attempting to roll the ball in the grooves through a full 720° angular distance.

With this difficult operational mode, and if desired, the construction of the instant inventive device could be such that the S-shaped cross-section illustrated in FIG. 8 were utilized as concerns the shape of the elongated band 10. To increase the difficulty even more and, in fact, to increase the difficulty of operation to a level approaching the impossible, multiple rolling ball-like playing pieces could be utilized simultaneously. In all modes of operation as discussed, the ultimate objective is to continuously roll the ball around the Mobius ring without allowing the ball to drop out of the grooves from the toy.

Thus, with one device of fascinating Mobius ring construction, a plurality of different operational modes is possible ensuring a challenge of a continuing nature to uses of different age levels and dexterity levels. The remaining objectives as set forth at the outset of the specification have similarly been achieved.

What I claim is:

1. A hand-held toy for challenging the manual dexterity and concentration of the user, said toy comprising:

an elongated band having grooves disposed in both sides thereof defining a raceway for a rolling ball-like playing piece said band being twisted about its longitudinal axis through an odd number of turns and having its ends permanently joined together to define a continuous Mobius ring;

an aperture disposed in said band communicating with the grooves to either side of said band and having a diameter sufficiently large to receive said ball-like playing piece therein;

door means positioned in said aperture to selectively open and close same;

an arcuate arched cover disposed over the groove along a selected distance on one side of said band at the region of said door; and handle means disposed on the Mobius ring coupled to said band for providing an area to be gripped by the user and from which the toy can be manipulated by hand to selectively allow the ball-like playing piece to roll in said grooves over an angular distance of up to 720° and through said door to opposite sides of said band.

2. A toy as defined in claim 1, wherein said cover is removable.

3. A toy as defined in claim 1, wherein said door means opens in one direction only and, when opened, additionally defines a deflecting stop for the ball-like piece causing the playing piece to be deflected through said aperture.

4. A toy as defined in claim 1, wherein said handle means is disposed across the Mobius ring to define an approximation of the diameter of said ring.

5. A toy as defined in claim 1, wherein said cover is transparent.

6. A hand-held toy for challenging the manual dexterity and concentration of the user, said toy comprising:

an elongated band having an S-shaped cross-section forming offset, open-sided, generally U-shaped grooves disposed in both sides thereof defining a raceway for a rolling ball-like playing piece, said band being twisted about its longitudinal axis through an odd number of turns and having its ends permanently joined together to define a continuous Mobius ring; and handle means disposed across the Mobius ring to define an approximation of the diameter of said ring for providing an area to be gripped by the user and from which the toy can be manipulated by hand to selectively allow the ball-like playing piece to roll in said grooves over an angular distance of 720°.

* * * * *